United States Patent [19]

Takanashi et al.

[11] Patent Number: 4,914,607

[45] Date of Patent: Apr. 3, 1990

[54] MULTI-SCREEN DISPLAY CONTROL SYSTEM AND ITS METHOD

[75] Inventors: Katsuya Takanashi; Kimitoshi Yamada, both of Hadano, Japan

[73] Assignee: Hitachi, Ltd., Tokyo, Japan

[21] Appl. No.: 35,982

[22] Filed: Apr. 8, 1987

[30] Foreign Application Priority Data

Apr. 9, 1986 [JP] Japan ..... 61-79919

[51] Int. Cl.[4] ..... G09G 1/16

[52] U.S. Cl. ..... 364/521; 340/721; 340/798; 382/45

[58] Field of Search ..... 364/518, 521; 340/721, 340/724, 798-800; 382/44-47

[56] References Cited

U.S. PATENT DOCUMENTS 4,542,376 9/1985 Bass et al. ..... 340/724
4,545,070 10/1985 Miyagawa et al. ..... 382/48
4,598,384 7/1986 Shaw et al. ..... 364/521 X
4,694,288 9/1987 Harada ..... 340/721
4,710,767 12/1987 Sciacero et al. ..... 340/799
4,714,918 12/1987 Barker et al. ..... 340/724

FOREIGN PATENT DOCUMENTS 58-168142 10/1983 Japan .

*Primary Examiner*—Gary V. Harkcom
*Assistant Examiner*—H. R. Herndon
*Attorney, Agent, or Firm*—Fay, Sharpe, Bell, Fagan, Minnich & McKee

[57] ABSTRACT

In a transfer data screen buffer added to a multi-window display, a command stream for displaying segments to be displayed and superposed over the multi-window display is stored. By the execution of the command stream, the display data developed into a bit map undergoes exclusive OR operation bit by bit with the bit-map developed data of the multi-window data. The operation result is fed back to the display screen bit map memory to be displayed.

3 Claims, 10 Drawing Sheets

ERASING BY EX-OR WITHIN FULL DOT MEMORY 23
(A⊕B)⊕B
79
78
77
B
PICTURE ELEMENT ADDRESS SYNC
A⊕B
6
15
CRT
FROM BIT MAP PROCESSOR 12

MULTI-SCREEN DISPLAY CONTROL SYSTEM AND ITS METHOD

CROSS-REFERENCE TO OTHER APPLICATIONS

The present invention relates to U.S. Pat. application serial No. 895,848 now U.S. Pat. No. 4,769,636 and European Patent Application No. 86,111,187.0, entitled "Display Control Method for Multi-window System" and applied by H. Iwami et al. on Aug. 12, 1986.

BACKGROUND OF THE INVENTION

The present invention relates to a display control apparatus and its method, and in particular to a display control system and its method suitable to the control of a multi-window system capable of displaying a plurality of windows overlapped on one screen.

In a work station operating under the multi-task environment, for example, multiple windows which can be overlapped are used. Each of a plurality of windows in the multi-window display is provided with an order of its display on one screen. A window provided with a higher order is displayed at the front side with respect to the operator, while a window provided with a lower order is displayed at depths.

A multi-window administration scheme as described in Japanese Patent Laid-Open No. JP-A-58-168142, for example, is known. However, the function of carrying out display over a plurality of windows in parallel to the display of drawing elements or segments within the multi-window or the function of displaying at high speed the state of an object moving from a window to another window is not mentioned.

The above described prior art has problems in that the data movement between multiple windows is not taken into account and the display control extending over windows is impossible.

SUMMARY OF THE INVENTION

Therefore, an object of the present invention is to provide a control system and a control method of overlapping multi-window display capable of rapidly moving drawing elements or segments over windows or displaying the movement locus of a drawing element between windows independently of the display control of respective windows.

Another object of the present invention is to provide a multi-window control system and its method capable of establishing logical planes used by an application program as display regions completely independent of overlapping multi-window display and capable of moving rapidly drawing elements without being conscious of collision between displays.

A further object of the present invention is to provide a multi-screen control capable of erasing rapidly the current display contents by the second display writing operation.

A further object of the present invention is to provide a display control system making it unnecessary to redevelop drawing elements or segments for moving rapidly drawing elements.

In order to achieve the above described objects, there are disposed a logical plane which is independent of respective windows representing the multi-window display and which has the same size as that of the physical screen, and a buffer for holding a drawing element command supplied via exclusive OR gates on the logic plane. Upon the drawing directive issued on respective windows, the exclusive OR logic operation is carried out while the drawing element command held in the buffer is executed. Further, the exclusive OR logic operation is carried out while the drawing element command held in the above described buffer is carried out again.

Since the display control is automatically carried out, the present logical plane operates independently of respective windows. When data are to be moved between windows or the drawing directive is issued beyond a window, therefore, the drawing directive is supplied to the logical plane and a picture is drawn via the exclusive OR gate. As a result, the drawing element can be moved at high speed.

DESCRIPTION OF THE PREFERRED EMBODIMENTS

Figure 1A:
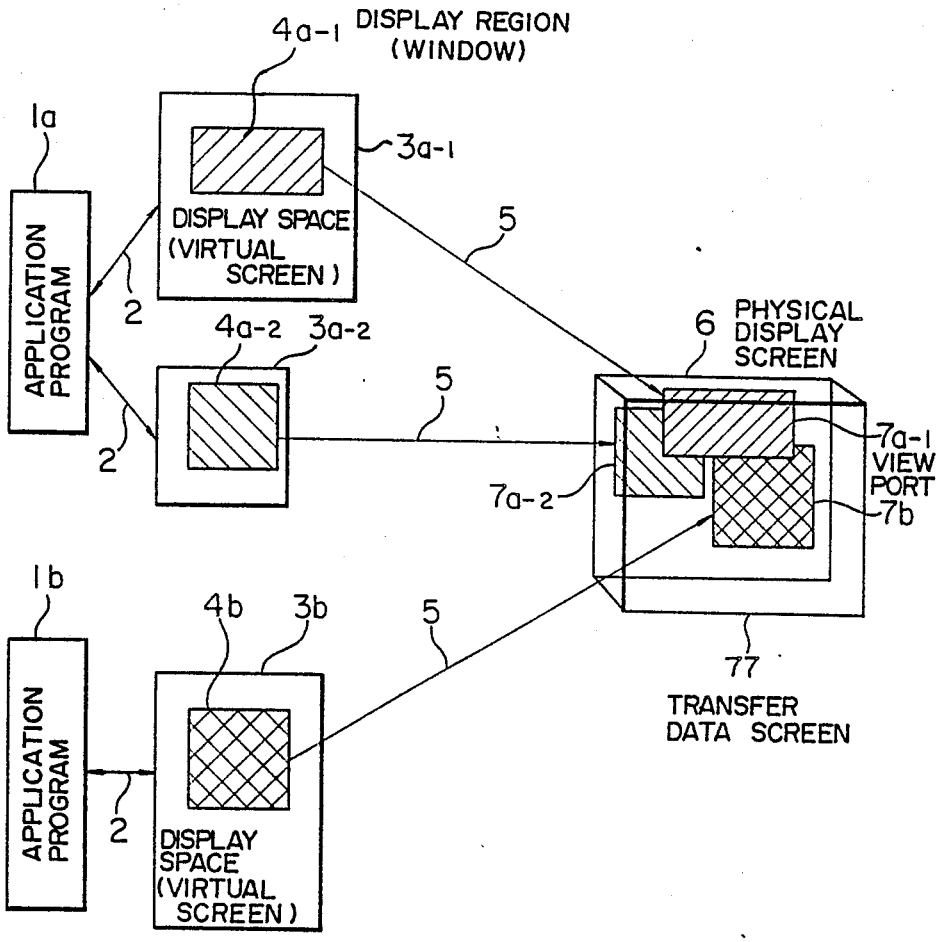
FIG. 1*a* is a concept diagram for illustrating the control of an overlapped display region which is an embodiment of the present invention.

An embodiment of the present invention will now be described in detail by referring to the drawings.

FIG. 1*a* is a concept diagram for illustrating an embodiment of the present invention. One or more logical display spaces 3*a*-1, 3*a*-2 and 3*b* (hereafter referred to as virtual screens) are assigned to each business content of application programs 1*a* and 1*b* shown in FIG. 1*a*. This virtual screen corresponds to a physical display screen for an application program in a conventional display control apparatus consisting of a single program and a single screen. As indicated by arrows 2, the operation for writing data from the application programs 1*a* and 1*b* onto each display space and the operation for reading data from each display space to the business program 1*a* and 1*b* are possible. In general, each virtual screen has an arbitrary size with respect to a real screen 6 (hereafter referred to a physical display screen). If it is impossible to develop all of virtual screens on the physical display screen 6 at one time, it is made possible to define smaller display regions 4*a*-1, 4*a*-2 and 4*b* (hereafter referred to as windows) as regions actually displayed on each virtual screen in order to simultaneously develop contents of respective parts of a plurality of virtual screens 3*a*-1, 3*a*-2 and 3*b*. A plurality of windows can be defined for one virtual screen. In a two dimensional coordinate system having the upper left corner point as the origin, each window is a rectangular region defined by specifying the position coordinates of the upper left corner point of the window and the length of the window in x and y directions. These windows are mapped into rectangular regions (hereafter referred to as view ports) 7*a*-1, 7*a*-2 and 7*b* on the physical display screen 6 and the contents are displayed. As indicated by arrows 5, those rectangular regions 7a-1, 7a-2 and 7b correspond in size and the number to the windows in one to one relationship. In a two dimensional coordinate system having the upper left corner point as the origin, each of these view ports is a rectangular region defined by specifying the position coordinates of the upper left corner point of the view port. View ports can be defined so as to allow overlapping of a plurality of view ports. Accordingly, a view port belonging to a lower layer is displayed on the physical display screen 6 with a part thereof being missing.

Figure 1B:
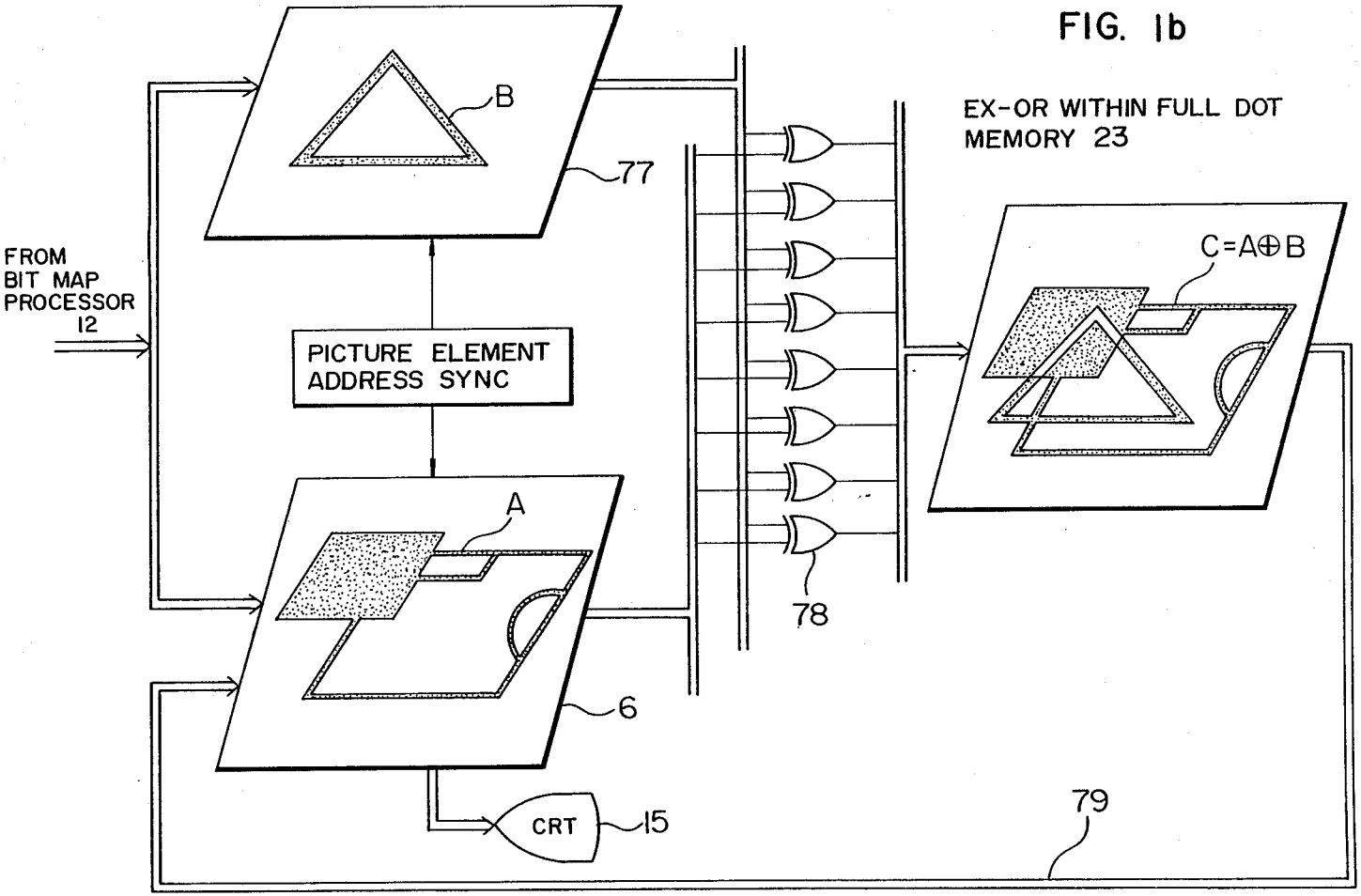
FIGS. 1*b* and 1*c* show the generation of exclusive OR data between bit map data.

For the display on such a physical display screen 6, a transfer data screen 77 is provided as a region of a logical plane for allowing it to freely draw a picture on the physical display screen 6 independently of the view ports 7a-1, 7a-2 and 7b corresponding to respective virtual screens 3a-1, 3a-2 and 3b. In order to patch data displayed within a view port with data displayed within another view port, for example, a picture can be drawn at high speed on the physical display screen 6 via the exclusive OR operation independently of other view ports 7 by using the logic plane 77. The operation is shown in FIG. 1b and will be described later in detail.

Figure 2:
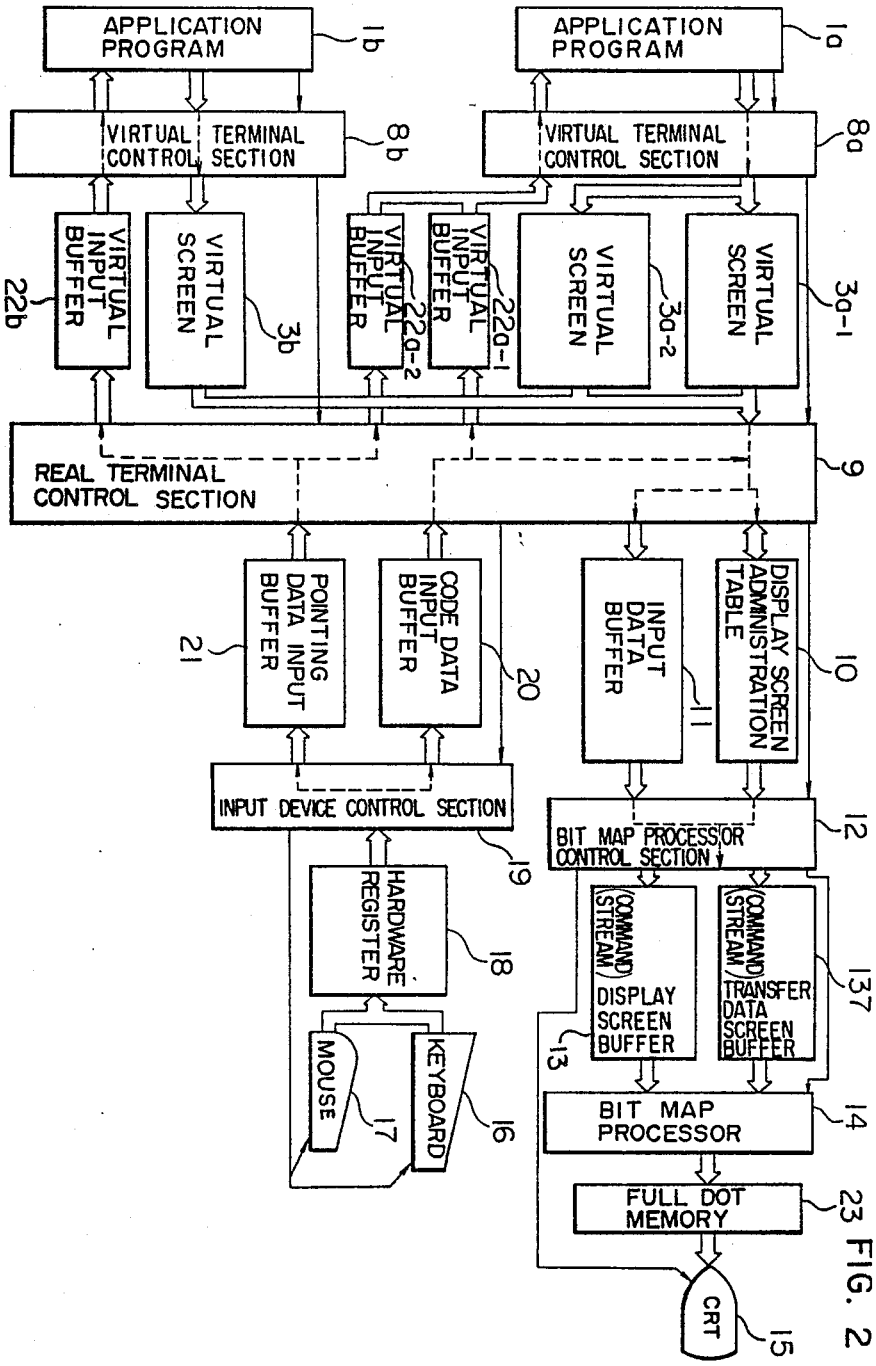
FIG. 2 is a block diagram for illustrating the configuration of a display control apparatus.

FIG. 2 is a block diagram for illustrating the configuration of an embodiment of a display control apparatus according to the present invention. Each block represents a logic block circuit or a data buffer. At first, the display system shown in the upper right portion of FIG. 2 will now be described. Each of application programs 1a and 1b supplies definition of virtual screens 3a-1, 3a-2 and 3b, corresponding windows 4a-1, 4a-2 and 4b, and view ports 7a-1, 7a-2 and 7b to virtual terminal control sections 8a and 8b having memories corresponding to virtual screens. Thereafter, graphic data such as characters, circles or linear lines, or external picture data inputted by the application program are written onto a virtual screen via the virtual terminal control section segment by segment. The virtual screen is administrated by the virtual terminal control section. The display system is thus started. In order to administrate the details of segment data on the virtual screen, the virtual terminal control section generates information concerning respective segments in addition to the displayed data on the virtual screen as the data common to a real terminal control section 9. The information generated includes attributes such as the position on the virtual screen, size, transparency/opacity and character space, classification of character/graphic/picture data, classification of solid line/broken line, and the display priority. Via the virtual terminal control section 8a or 8b, the real terminal control section 9 derives the information for defining the window 4 and the view port 7 defined by the business program 1. On the basis of the information thus derived, the real terminal control section 9 generates a display screen administration table 10 which will be described later. By using this administration table 10, the real terminal control section 9 extracts the information required for developing on the physical display screen 6 out of the segment data on respective virtual screens 3 segment by segment. Depending upon which virtual screen 3 the drawing directive is destined for, the real terminal control section 9 generates an entry number for indicating the particular view port 7 on the basis of the rectangular region information on the administration table 10. On the basis of this entry number, a display order for each view port is indicated. Portions of view ports of lower ranks are lost due to overlapping.

On the basis of the segment data and the entry number, the bit map processor control section 12 generates a command stream in a display screen buffer 13. The command stream directs a bit map processor to display which part of which view port on which part of the physical screen. At this time, the bit map processor control section 12 loads the character pattern corresponding to the character code contained in each segment of the character/graphic data onto the display screen buffer 13. For the physical display screen 6 of a full dot memory 23 developed on a CRT 15, the bit map processor control section 12 establishes a drawable region, i.e., a region on the physical display screen where a picture can be drawn, on the basis of the rectangular region information stored in the administration table 10. Thus the bit map processor control section 12 establishes a command in the display screen buffer 13. The command includes the specification of the drawing position of the character/graphic/picture data in a two dimensional coordinate system having the upper left corner of the full dot memory 23 as the origin. In case of character data, a command including the size, developing direction, and character code or pattern number of each character region is stored in the buffer 13. In case of graphic data, a command including the vector command, shading pattern and marker pattern is stored in the buffer 13. In case of picture data, a command including the MH/MR compressed code data of CCITT and its rectangular region size is stored in the buffer 13. The bit map processor 14 interprets the command sequence contained in the buffer 13, judges whether the dots should be included in the drawable region when the character/graphic/picture data is developed into dots, and carries out clipping processing for leaving only the portions included in the drawable region.

The input system located at the lower right portion of FIG. 2 will now be described. An input device control section 19 traps as an interrupt the data input trigger supplied from physical input devices of a code input unit 16 such as a keyboard and a pointing device 17 such as a mouse. The input device control section 19 sets the data set in a hardware register 18 into a code data input buffer 20 and a pointing data input buffer 21. The input system is thus driven. The contents of the code data input buffer 20 and the pointing data input buffer 21 are read out by the real terminal control section 9 and sorted there into input data to the application program 1 and data for directing the display screen control. On the basis of the input data sorted into the drawable region information of the display screen table and the application program 1, the real terminal control section 9 judges which is now the virtual screen 3 corresponding to the view port 7 located on the top layer of the display screen, and stores the pertinent input data into one of the virtual input data buffers 22a-1, 22a-2 and 22b administered by the virtual terminal control section 8 corresponding to the pertinent virtual screen 3. This input data stored in the virtual input data buffer 22 is reported by the virtual terminal control section 8 to the application program 1 as the answer to the readout request sent from the application program 1 to the virtual terminal control section 8. The application program 1 updates the contents of the virtual screen 3 in response to the pertinent input data.

How to administrate the data on the transfer data screen 77 will now be described by referring to FIGS. 1*b* and 3. By using the transfer data screen 77, it is possible to draw freely a picture on the physical display screen 6 inpendently of a plurality of view ports 7 on the physical display screen 6. In the same way as the data on other virtual screens 3, all of the data on the screen 77 are administered while taking the segment indicated by 30 as unit. On the screen 77, a plurality of segments are so disposed as to allow the overlap. The drawing elements of each segment 30 are specified from the relative position coordinates of either the upper left corner point or the lower left corner point of the segment in a two dimensional coordinate system having the upper left corner point of the screen 77 (preferably having the same size as the physical display screen 6 and) having the upper left corner point as the origin. Independently of the drawing elements within the view port 7 which is a visual portion of each virtual screen 3, a command for generating the drawing element data within each segment 30 is held in a transfer data screen buffer 137 to draw a picture on the physical display screen 6 or move a picture at high speed by using the screen 77.

Figure 5A:
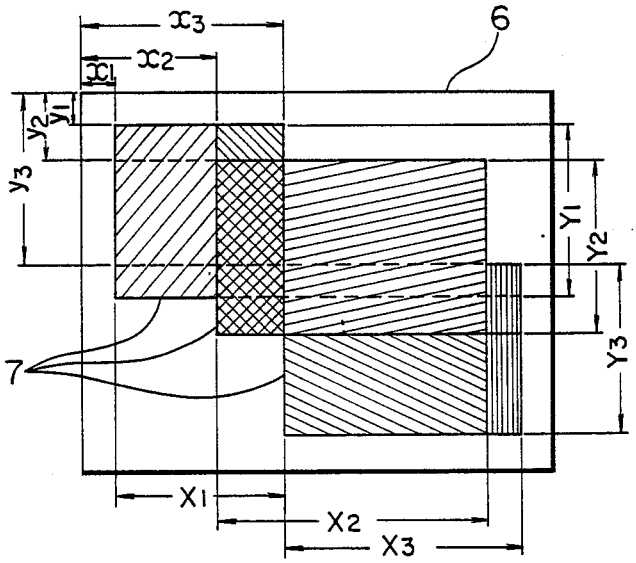
FIGS. 5*a* and 5*b* are diagrams for illustrating the display screen administration table.
Figure 5B:
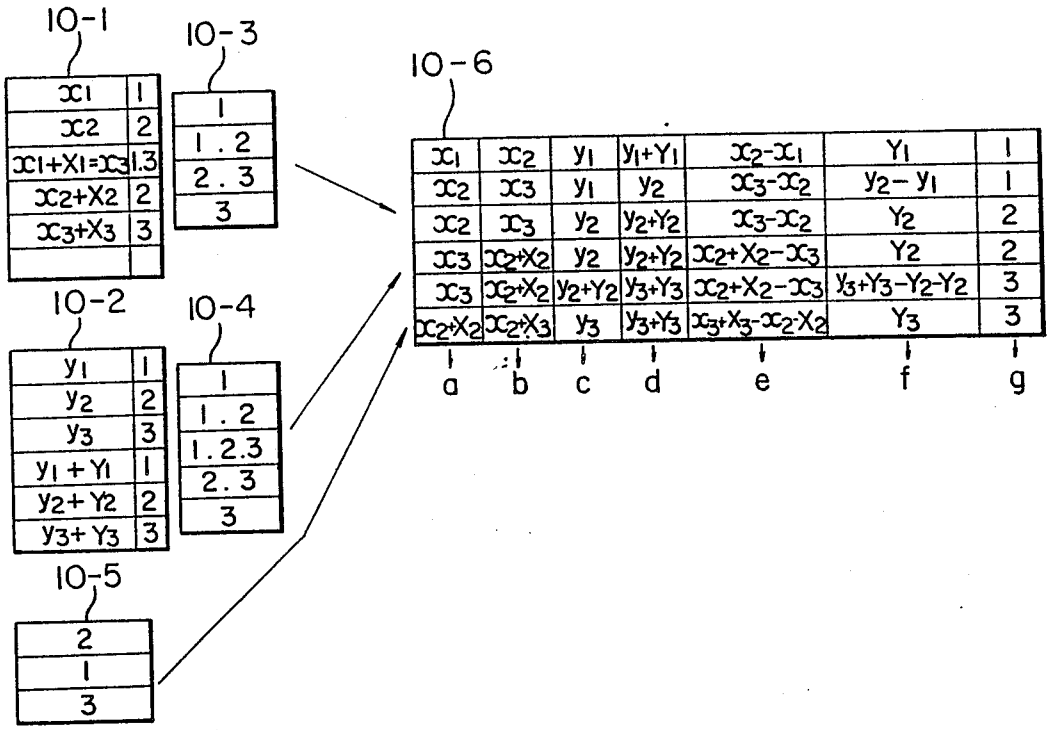

FIGS. 5*a* and 5*b* show the contents of the display screen administration table 10 in the real terminal control section 9. This administration table is mentioned in the U.S. Pat. application serial No. 895,848 and the corresponding European Patent Application No. 86,111,187. 0.

The real terminal control section 9 sorts the information defining the view port 7 as a rectangular region on the physical display screen 6 into the x and y directions as the positional coordinates of respective sides of each rectangular region, and holds the information thus sorted together with the corresponding view port identifier (tables 10-1 and 10-2). When the x and y directions are seen independently between sets of two entries of tables 10-1 and 10-2 having consecutive entry values (such as entries 1 and 2, and entries 2 and 3), view port identifiers existing in the region range indicated by the two-valued entry are held (tables 10-3 and 10-4). In a region where the view ports 7 are overlapped, as many view port identifiers as the overlaps are stored. Apart from that, the information representing the overlap priority of the view port 7 at that time is stored in a table 10-5.

By using the information stored in the tables 10-1 to 10-5, a main table 10-6 of the current display screen administration table 10 is generated as follows. The set of two consecutive values contained in the table 10-1 (such as entries 1 and 2, and entries 2 and 3) are selected as one body. If the corresponding entry of the table 10-3 singly holds only a view port identifier, all of the entries containing the same view port identifier among the entries of the table 10-4 are searched. The corresponding y coordinates are derived from the table 10-2. If, in any case, the entries of the table 10-4 satisfying the search condition are consecutive, they are put together to derive the y coordinate.

From the x and y coordinates thus derived, one entry of the table 10-6 is produced. By using this, the overlap order of each view port 7 is administered. Each entry of the table 10-6 represents a rectangular region on the physical display screen 6. And two x coordinates a and b (such as x coordinates $x_1$ and $x_2$ corresponding to the entry 1 of the table 10-3), two y coordinates c and d (such as y coordinates $y_1$ and $Y_{1+y1}$ corresponding to the entries 1 to 3 of the table 10-4), length e in the x direction (derived as $e=b-a$), length f in the y direction (derived as $f=d-c$), and the corresponding view port identifier g are held.

The correspondence between the virtual screen 3 and the physical display screen 6 has been described before. In the present embodiment, n (where n is an integer) virtual screens 3 can be simultaneously displayed on the physical display screen 6 by using the display screen administration table 10 described by referring to FIGS. 5*a* and 5*b* and the real terminal control section 9. The virtual terminal control section 8 is able to direct to draw a picture on an individual window 4 without being conscious of the mutual relation with other windows at all. In addition, the real terminal control section 9 carries out alteration of the display state of the physical display screen such as alteration of the overlap order of the view ports 7 or the alteration of the size of the view ports 7 by referring to the administration table 10.

Figure 3:
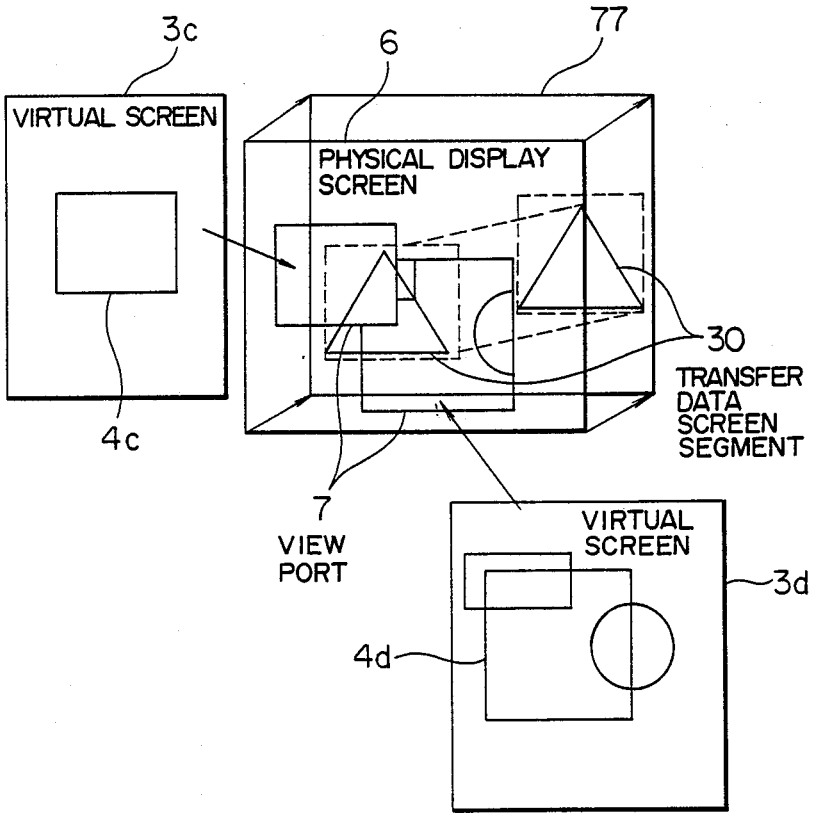
FIG. 3 shows the administration method of the transfer data screen.
Figure 4:
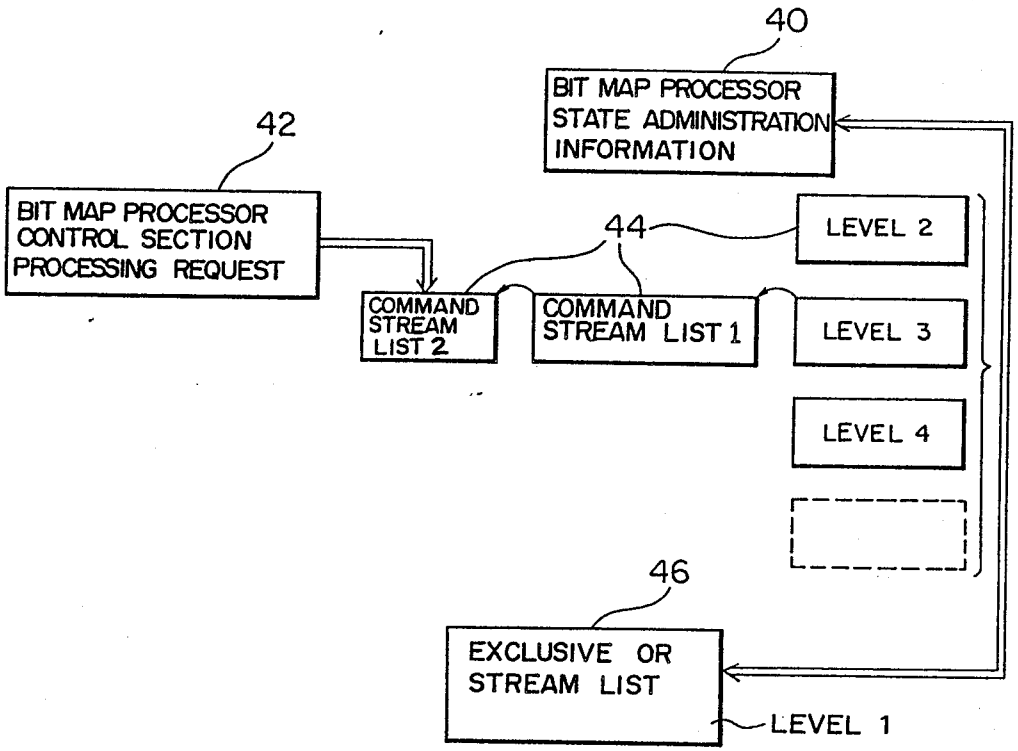
FIG. 4 is a diagram for illustrating the table configuration of FIG. 3.

FIG. 4 shows the table configuration for administrating the drawing element within the segment 30 directed to be drawn on the screen 77 of FIG. 3 by a command held in the transfer data screen buffer 137. When the request to display the drawing elements of the segment 30 on the screen 77 is issued from the real terminal control section 9, the bit map processor control section 12 assures an unused buffer portion within the transfer data screen buffer 137. The contents of the requested drawing elements are copied from the input data buffer onto the unused buffer portion and are queued in a stream list 46. This exclusive OR stream list 46 administers the buffer portions in use. A command stream list 44 of the bit map processor 14 for administering the display screen buffer 13 has levels 1 to 4, for example, on the order of display priority.

These command streams are roughly classified into drawing commands for windows 4 of respective virtual screens 3 and drawing commands for the transfer data screen 77. When the real terminal control section 9 issues a drawing command to the screen 77, it provides the top of the command stream for the bit map processor control section 12 with a transfer data screen identifier. In case of the drawing directive for other virtual screens, a virtual screen identifier or No. is provided. Upon receiving the command stream, the bit map processor control section 12 sorts the command stream into the transfer data screen buffer 137 or the display screen buffer 13 on the basis of the virtual screen identifier. The command stream is thus stored.

If a drawing directive is issued to the virtual screen 3 to move the drawing element on the virtual screen 3, the bit map processor 14 carries out the exclusive OR stream list 46 surely once before or after it executes a processing request 42 of the command stream list 44 of the level 2 to 4. A portion of a display segment within the physical display screen 6 of FIG. 1*b* overlapping display segment B within the transfer data screen 77 is displayed as represented by $C=A\oplus B$ as a result of exclusive OR operation: black (1)+black(1)=white(0) carried out by an exclusive OR circuit 78. One figure is prevented from being buried into another figure. FIG. 1*b* shows the figure obtained as a result of exclusive OR operation $A\oplus B=C$ in case of monochrome. In the operation for color display using R, G and B, the color of the overlapped portion of figures having the same color can be replaced by the complementary color. In this case, three exclusive OR circuits are disposed for each picture element to derive the operation data $C=A\oplus B$. Whichever data is fed back to the memory of the physical display screen 6 via a line or bus 79 to be displayed on a CRT 15 instead of previous display data A.

Figure 1C:
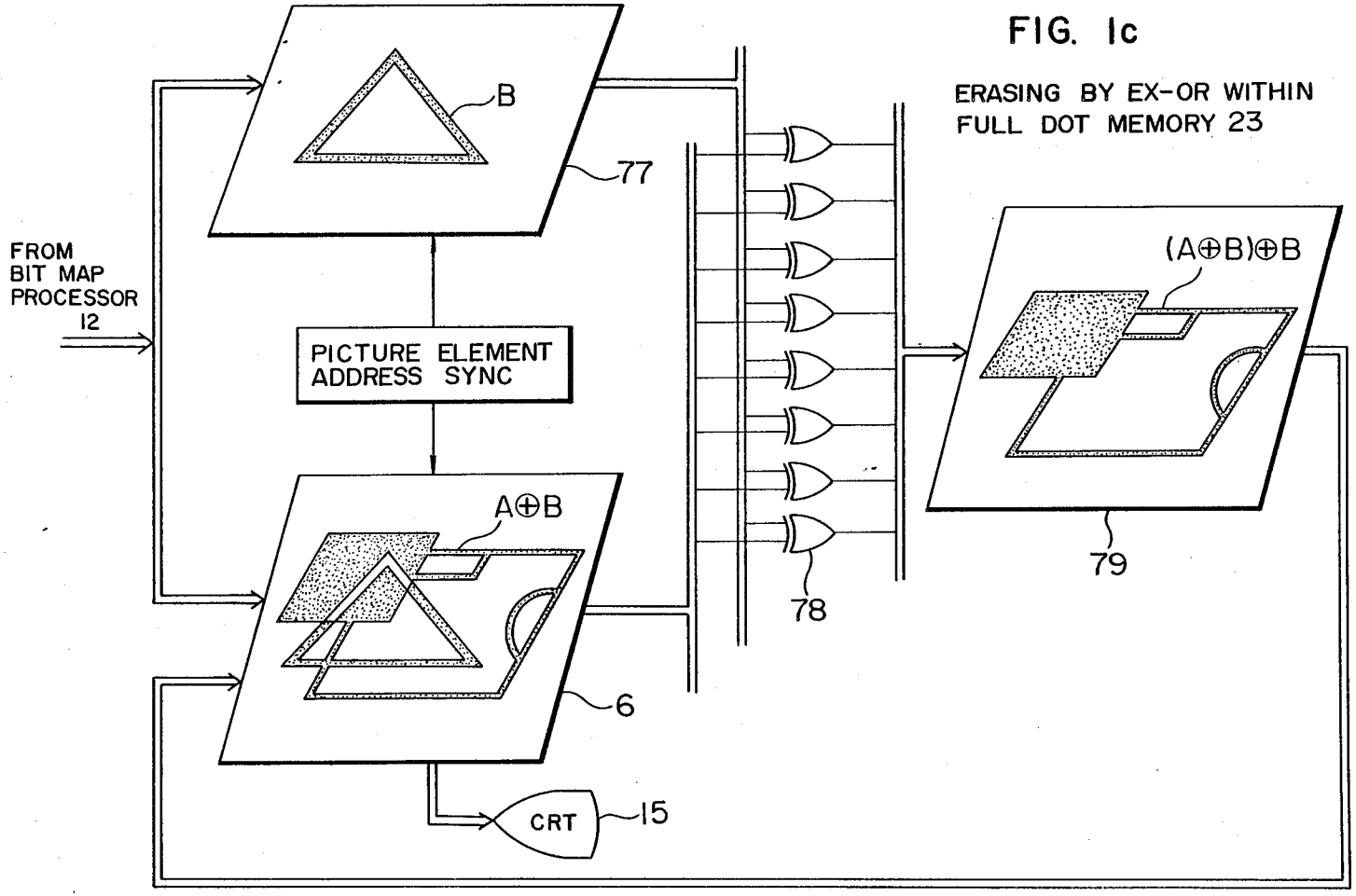

When a drawing element or a segment of the segments 30 on the screen 77 is to be erased, the pertinent segment is searched in the exclusive OR stream list 46, and an indicator for representing the erase is written onto the buffer in the pertinent stream list 46. For the command having the erase indicator set to the erase state, the exclusive OR stream is executed. For the data A⊕B and data B representing figures of FIG. 1*c*, addition $(A\oplus B)\oplus B=A$ is carried out to derive data 79 with a triangle B deleted. When all erase indicators of commands of the pertinent exclusive OR stream list 46 has turned to erase states, the pertinent exclusive OR stream list 46 is released.

When elements drawn on individual windows 4 are moved between windows, the demand for drawing the locus of the movement can be realized by drawing an element on a logic plane called "transfer data screen" which is disposed on the physical screen independently of respective windows 4.

Figure 6:
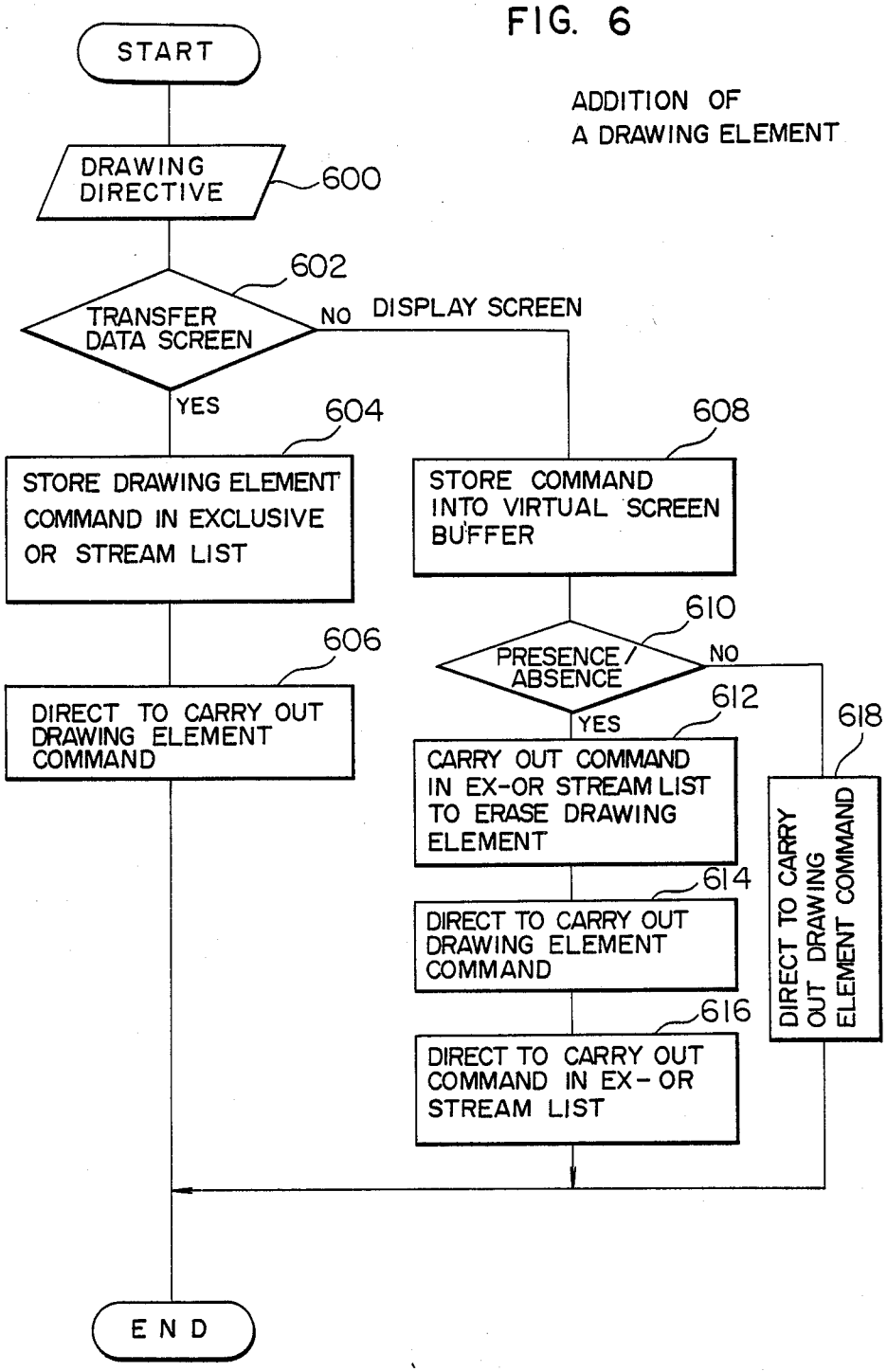
FIGS. 6 and 7 are flow charts for illustrating the processing of a real terminal control section.

FIG. 6 is a flow chart of the real terminal control section 9 for realizing the transfer data screen, which has the same size as the physical screen and which is capable of displaying completely independently, on a multi-window. Processing carried out when a drawing directive is issued to the transfer data screen is shown in FIG. 6.

When the drawing directive is issued to the real terminal control section 9 (step 600), it is judged on the basis of the identifier whether the directive is destined for a window which is a virtual terminal or destined for the transfer data screen (step 602). If the result is a request for the transfer data screen 77, a command of the segment or drawing element is additively stored in the exclusive OR stream list 46 (step 604). When the drawing element command has been executed by using the exclusive OR operation, a picture is drawn on the screen 77 (step 606).

If the result of judgment at the step 602 is a request to the window 4, the drawing directive command is stored into the buffer 22 of the virtual screen 3 (step 608). On the basis of an identifier stored in the display screen administration table 10 so as to represent the presence/absence of the transfer data, it is then judged whether the drawing element is being displayed on the screen 77 (step 610). In case of presence, the command within the exclusive OR stream list is executed (step 612). The drawing element drawn on the screen is erased and the drawing directive command is executed (step 614). Thereafter, a command in the exclusive OR stream list 46 is executed (step 616). Drawing on the window 4 is thus completed without disturbing drawing on the screen 77. When the drawing element is absent on the screen 77, the drawing element command is simply executed (step 618).

Owing to the above described control, it is possible to issue a drawing directive to the application program sending the drawing request to the window 4 without being conscious of the drawing element of the transfer data screen 77. Further, it is possible to freely issue a drawing directive request of the screen 77 from the application program 1 or the real terminal control section 9 regardless of the display states of other windows.

In a display apparatus for realizing the multi-task of simultaneously displaying a plurality of businesses, the present embodiment makes it possible to establish a logical plane completely independently of multiple windows which can be overlapped and which are used as display regions by each business program. Without being conscious of collision of displays, therefore, the drawing element can be moved at high speed. Further, it becomes possible to represent the locus of the frame when the frame of the window is drawn on the transfer data screen and the size of the frame is gradually changed in display to the operator. It is also possible to represent the locus obtained when the drawing element is moved from the window to a different rectangular display region.

Figure 7:
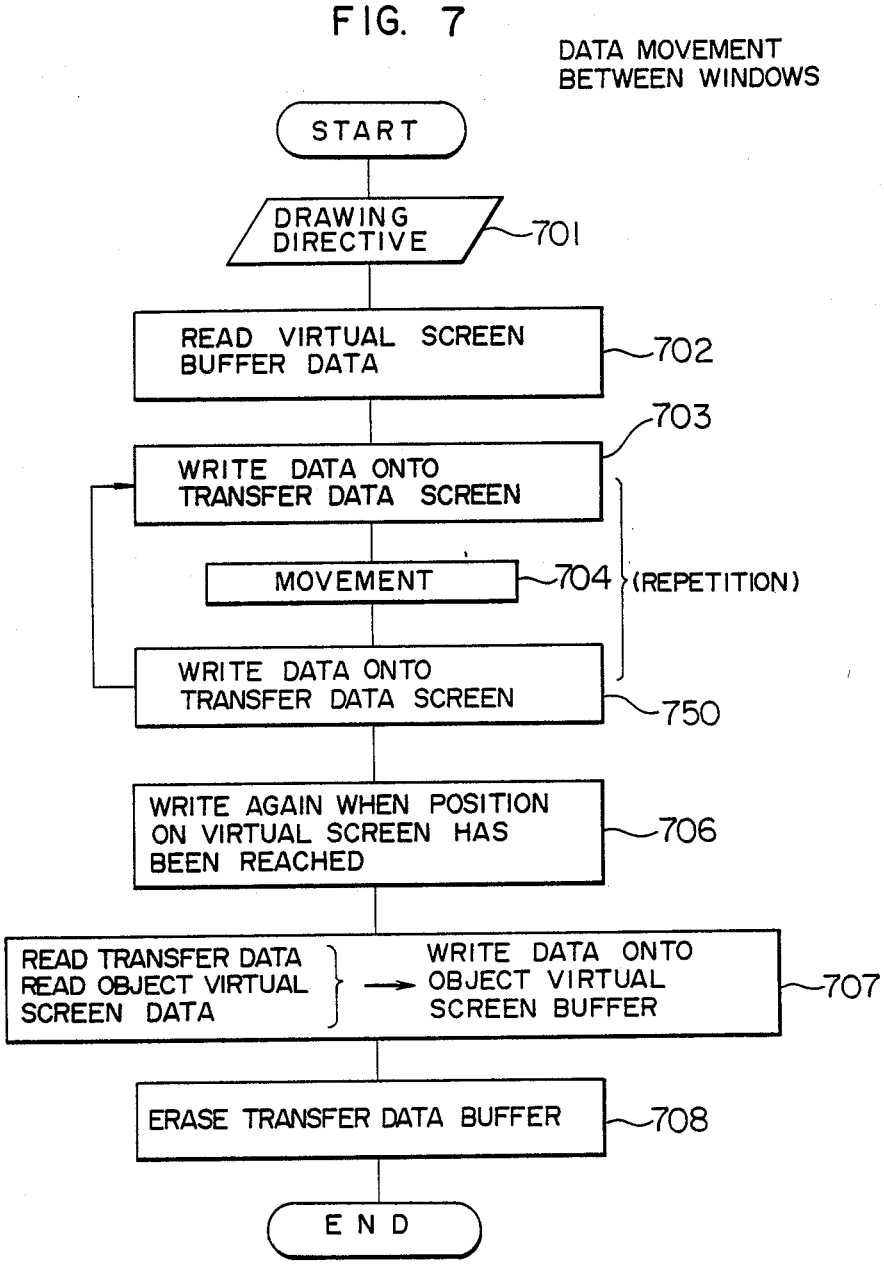

FIG. 7 shows the program for displaying the process of an image gradually moving between windows of virtual screens. In this program, the appearance and disappearance of the image caused by writing data into the transfer data screen twice (703, 704) and appropriate movement of the image (704) are repeated.

We claim:

1. A display control apparatus for simultaneously displaying portions of a plurality of virtual data windows on a display comprising:

(a) a first screen memory for storing a part of the data of virtual data windows in such a form that the data for only one virtual data window will be displayed for a region where more than one window overlaps on the display;

(b) a second screen memory for storing additional data to be displayed:

(c) means for writing the data of said second screen memory into the first screen memory so that the data of the first screen memory changes logical state when the second screen memory data is written;

(d) means for generating a display command stream from one of several types of display directives inputted to said display control apparatus;

(e) first buffer means for holding a first generated display command stream from a first type of display directive;

(f) second buffer means for holding a second generated display command stream from a second type of display directive;

(g) means for executing the display command stream held in said first buffer means to form the display data for said first screen memory, and for executing the display command stream held in said second buffer means to form the display data for said second screen memory; and (h) said writing means including an exclusive OR operation with respect to data from said first and second memory screens and for supplying the exclusive OR operation result to said first screen memory.

2. A display control system comprising:

a display screen;

a means for storing data to be displayed upon the display screen;

a means for writing the data to be displayed into the storing means;

a means for generating writing commands for the writing means, the commands contain the data to be stored, the address where the data is to be stored in the storing means and a priority for the data to be stored whereby the writing means selectively writes the data into the storing means in a predetermined correspondence with the data priority administering a display of multiple data windows on the display screen;

a second means for generating writing commands for the writing means which contain a second data to be stored and the address where the data is to be stored in the storing means; and a means for inserting the second data from the second generated writing commands into the storing means so that the data previously stored at the address in the storing means changes logic state whereby a graphic element is imposed upon the display screen irrespective of the multiple data windows formed by the priorities of the first generated commands, wherein said inserting means comprises exclusive OR operation between data in the storing means at the address contained in the second generated writing command and data contained in the second generated writing command.

3. The display control system as defined in claim 2 wherein the graphic element comprises a graphic character.

* * * * *